US009354592B2

(12) United States Patent
Kakutani et al.

(10) Patent No.: US 9,354,592 B2
(45) Date of Patent: May 31, 2016

(54) IMAGE FORMING APPARATUS HAVING PREARRANGED CONTROL BOARD, POWER SOURCE BOARD, AND FIXING, CONVEYANCE, TOWER SUPPLY AND EXPOSURE UNITS

(71) Applicant: CANON KABUSHIKI KAISHA, Tokyo (JP)

(72) Inventors: Toshifumi Kakutani, Abiko (JP); Shinya Suzuki, Toride (JP); Hirohisa Kato, Toride (JP); Yousuke Hata, Ichikawa (JP); Takeyuki Suda, Nagareyama (JP); Kazumi Sato, Kashiwa (JP); Manabu Koseki, Sakuragawa (JP); Toshiyuki Abe, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/320,828

(22) Filed: Jul. 1, 2014

(65) Prior Publication Data

US 2015/0016835 A1 Jan. 15, 2015

(30) Foreign Application Priority Data

Jul. 12, 2013 (JP) ..... 2013-146538

(51) Int. Cl.
*G03G 15/00* (2006.01)
*G03G 21/16* (2006.01)

(52) U.S. Cl.
CPC ..... *G03G 21/1604* (2013.01); *G03G 21/1642* (2013.01); *G03G 21/1652* (2013.01)

(58) Field of Classification Search
CPC ..... G03G 15/80; G03G 21/1652; G03G 2221/166
See application file for complete search history.

(56) References Cited

U.S. PATENT DOCUMENTS

| | | | | |
|---|---|---|---|---|
| 5,561,499 | A * | 10/1996 | Setoriyama | 399/111 |
| 5,815,771 | A * | 9/1998 | Dhande et al. | 399/90 |
| 5,822,654 | A * | 10/1998 | Damji et al. | 399/111 |
| 5,881,340 | A * | 3/1999 | Stickney et al. | 399/110 |
| 5,918,089 | A * | 6/1999 | Malinich et al. | 399/90 |
| 6,173,150 | B1 | 1/2001 | Suzuki et al. | |
| 6,438,337 | B1 | 8/2002 | Abe | |
| 6,951,688 | B2 | 10/2005 | Kato et al. | |
| 6,975,814 | B2 * | 12/2005 | Tsusaka et al. | 399/6 |
| 7,218,875 | B2 * | 5/2007 | Baruch et al. | 399/69 |
| 7,242,884 | B2 * | 7/2007 | Baruch et al. | 399/67 |
| 7,260,338 | B2 * | 8/2007 | Baruch et al. | 399/67 |
| 7,356,266 | B2 * | 4/2008 | Tokuzaki | 399/13 |
| 7,403,741 | B2 * | 7/2008 | Yoshihara et al. | 399/411 |
| 7,599,638 | B2 | 10/2009 | Nakano | |

(Continued)

*Primary Examiner* — David Bolduc
(74) *Attorney, Agent, or Firm* — Fitzpatrick, Cella, Harper & Scinto

(57) ABSTRACT

The power source board is arranged at a lower side on the back side of the main body of the image forming apparatus. The load control board is arranged at an upper side in a vertical direction of the power source board in such a manner that the load control board does not overlap with the power source board. For a board and load at a lower side when viewed from a load control board, a connector is arranged near the lower side of the load control board. For a board and load at an upper side of the load control board, a connector is arranged near the upper side of the load control board. Similarly, for boards and loads of right and left side, connectors are arranged near the respective right and left sides of the load control board.

11 Claims, 6 Drawing Sheets

(56) References Cited

U.S. PATENT DOCUMENTS

| | | | | |
|---|---|---|---|---|
| 2002/0168197 | A1* | 11/2002 | Kitozaki | 399/88 |
| 2006/0024078 | A1* | 2/2006 | Matsusaka | 399/88 |
| 2006/0269312 | A1* | 11/2006 | Muraishi | 399/88 |
| 2007/0147872 | A1* | 6/2007 | Nakano | 399/88 |
| 2007/0230988 | A1* | 10/2007 | Nobe et al. | 399/88 |
| 2008/0170604 | A1* | 7/2008 | Komoda | 375/214 |
| 2009/0035007 | A1* | 2/2009 | Eom | 399/88 |
| 2009/0059262 | A1* | 3/2009 | Takuwa | 358/1.13 |
| 2009/0073478 | A1* | 3/2009 | Takuwa | 358/1.13 |
| 2009/0175647 | A1* | 7/2009 | Suzuki | 399/92 |
| 2010/0098451 | A1* | 4/2010 | Tsusaka et al. | 399/90 |
| 2010/0226683 | A1* | 9/2010 | Yamaguchi | 399/110 |
| 2011/0119420 | A1 | 5/2011 | Hata | |
| 2012/0044521 | A1* | 2/2012 | Suzuki et al. | 358/1.15 |
| 2012/0207504 | A1* | 8/2012 | Hamaya | 399/88 |
| 2012/0321365 | A1* | 12/2012 | Sendo et al. | 399/410 |
| 2013/0322911 | A1* | 12/2013 | Hamaya et al. | 399/88 |

* cited by examiner

IMAGE FORMING APPARATUS HAVING PREARRANGED CONTROL BOARD, POWER SOURCE BOARD, AND FIXING, CONVEYANCE, TOWER SUPPLY AND EXPOSURE UNITS

BACKGROUND OF THE INVENTION

1. Field of the Invention

The present invention relates to an arrangement of boards, wirings and connectors in an image forming apparatus such as printer, multifunction peripheral etc.

2. Description of the Related Art

An arrangement of the components in the conventional general image forming apparatus is described with reference to FIG. 6. FIG. 6 is a diagram illustrating the image forming apparatus when viewed from a back side of a main body. In FIG. 6, broken lines show components, which are invisible from the back side of the main body. Such components include photoreceptor drums 404, developing devices 405, an intermediate transfer belt 401, a laser exposure device 408, primary transfer roller 414, a fixing device 450, a sheet feeding cassette 421, a delivery tray 425, toner bottles 430Y, 430M, 430C, 430K and the like.

On the back side of the image forming apparatus, an image control board 503, connected to a user interface for controlling an image forming process, is arranged, when viewed from the back side, at an upper left part. A load control board 501 is arranged at an upper right part when viewed from the back side of the image forming apparatus in parallel with the image control board 503. The load control board 501 is used to control driving system load components and sensors of the image forming apparatus. A power source board 502 is arranged at a lower part when viewed from the back side. The power source board 502 is to distribute AC power supplied from a commercial power supply, or to convert the AC power into DC power. High voltage boards 504 and 505 are arranged near the photoreceptor drum 404 and the developing device 405. Motors 515 and 516 are arranged side by side with the high voltage board 504. The motors 515 and 516 are to drive the photoreceptor drum 404 and a screw in the developing device 405. Conveyance driving motors 512 and 513 are arranged near a recording paper conveyance path. The conveyance driving motors 512 and 513 are to drive rollers for conveying a recording paper from the sheet feeding cassettes 421.

The load control board 501 supplies control signal and power to the load components such as motors and each board. In U.S. Pat. No. 7,599,638B2, a board corresponding to a load control board is separated into two boards. The separated boards are arranged inside and outside by sandwiching a main body frame of an image forming apparatus in between to downsize the image forming apparatus.

Providing a simple structure by decreasing the length of wiring as much as possible is effective for reducing troubles relating to wiring such as a short circuit when assembling the image forming apparatus or when exchanging parts. It is also effective for reducing costs.

In the conventional image forming apparatus as shown in FIG. 6, the load control board 501 is arranged away from the respective load components and boards. Therefore, wirings for communicating control signal and wirings for supplying power are diagonally arranged on the back side of the main body. This increases the wiring length and costs. Also, there may increase a risk of a wiring short circuit when assembling or exchanging parts.

According to the image forming apparatus as described in U.S. Pat. No. 7,599,638B2, downsizing of the image forming apparatus is achieved, however, further improvement is still required for wiring.

SUMMARY OF THE INVENTION

In order to solve the above-mentioned problem, it is a main object of the present disclosure to provide an image forming apparatus, which is simply constituted by decreasing the length of the wiring as much as possible.

In order to solve the above-mentioned problem, there is provided an image forming apparatus comprising: a storing unit configured to store a recording paper; a conveyance unit configured to convey the recording paper stored in the storing unit; a conveyance driving unit configured to drive the conveyance unit; an exposure unit; a photoreceptor; a transfer unit configured to transfer a toner image formed on the photoreceptor to the recording paper conveyed by the conveyance unit; a fixing unit configured to fix the transferred toner image to the recording paper; a toner storage container; a toner supply unit configured to supply toner of the toner storage container; a driving unit configured to drive the photoreceptor; a control board, connected to the driving unit through a signal line, for controlling the driving unit; a power source board for supplying power for use in the image forming apparatus from a commercial power supply. The photoreceptor is arranged at the upper side than the storage unit in a vertical direction and at a lower side than the toner storage container in the vertical direction. The control board and the power source board are arranged on the back side of the image forming apparatus in different positions in a vertical direction in such a manner that the control board does not overlap with the power source. The control board is arranged above the power source board in a vertical direction. A first connector for a wiring which connects the control board and the power source board is arranged at a lower side of the control board. The fixing unit is arranged at an upper left side of the control board in a vertical direction when viewed from the back side of the image forming apparatus. A second connector for a wiring which connects the control board and the fixing unit is arranged at an upper left part of the control board. The conveyance driving unit is arranged at the lower left side of the control board in the vertical direction when viewed from the back side of the image forming apparatus. A third connector for a wiring which connects the control board and the conveyance driving unit is arranged at the lower left part of the control board when viewed from the back side of the image forming apparatus. A fourth connector for a wiring which connects the control board and the toner supply unit is arranged at the upper side of the control board when viewed from the back side of the image forming apparatus. A fifth connector for a wiring which connects the control board and the exposure unit is arranged at a right side of the control board when viewed from the back side of the image forming apparatus.

Further features of the present invention will become apparent from the following description of exemplary embodiments (with reference to the attached drawings).

DESCRIPTION OF THE EMBODIMENTS

Now, various exemplary embodiments, features, and aspects of the present disclosure are described below in detail with reference to the drawings.

Figure 1:
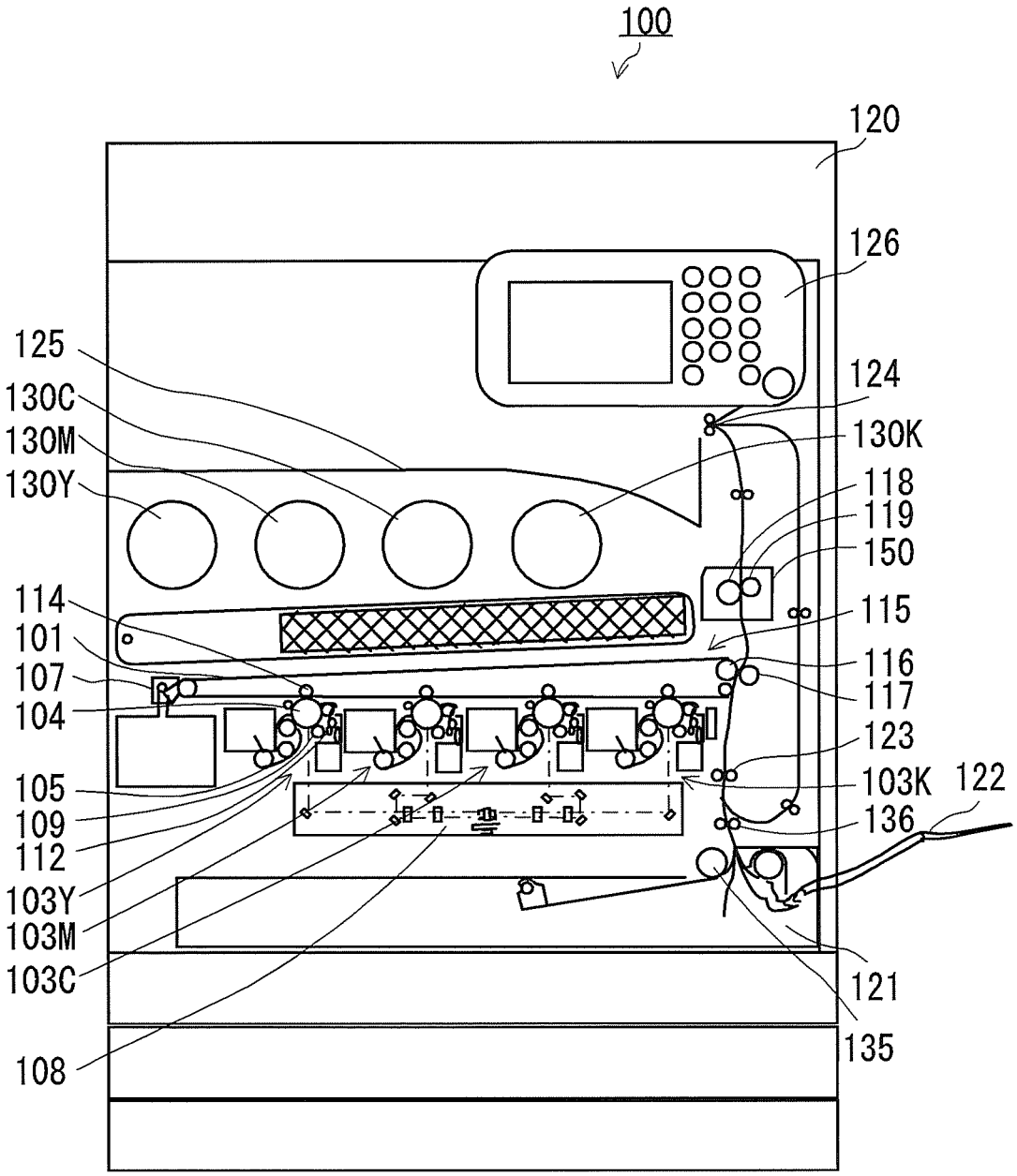
FIG. 1 is a diagram illustrating a configuration of an image forming apparatus.

FIG. 1 is a diagram illustrating a configuration of a basic image forming apparatus 100. The image forming apparatus 100 comprises a user interface (UI) 126 having buttons and display section for receiving instructions from a user and a document reading part 120 for reading an image information from an original. The document reading part 120 is a scanner, for example. The image forming apparatus 100 also comprises a sheet feeding cassette 121 for storing a recording paper on which an image is formed. The sheet feeding cassette 121 is arranged at the lowest part of the main body in such a manner that a bottom plate of the main body of the image forming apparatus 100 is placed in parallel with the recording paper. The image forming apparatus 100 is a full color image forming apparatus of an electro-photographic system, in which toner storage containers for storing toner used as developer are detachable. The toner storage containers include toner bottles 130Y, 130M, 130C, and 130K.

The image forming apparatus 100 comprises detachable process cartridges 103Y, 103M, 103C and 103K arranged on approximately a straight line in a horizontal direction at fixed intervals. The process cartridges 103Y, 103M, 103C and 103K respectively form images of yellow (Y), magenta (M), cyan (C), and black (K). The process cartridges 103K, 103M, 103C and 103K all have the same construction. Here, the construction of the process cartridge 103Y will be described. As to the structures of the rest of the process cartridges 103M, 103C and 103K, the description will be omitted. The process cartridge 103Y comprises a drum type electrophotographic photoreceptor (hereinafter referred to as "photoreceptor drum") 104 as an image carrier. A primary charger 109, a developing device 105, and a drum cleaner 112 are arranged around the photoreceptor drum 104.

The photoreceptor drum 104, which is a negatively charged organic photo conductor (OPC) and which has a photoconductive layer on a drum board made of aluminum, is rotatively driven by a driving apparatus (not shown) at a constant process speed. The primary charger 109 uniformly charges the surface of the photoreceptor drum 104 to a predetermined negative potential by a primary transfer high voltage applied from a charged bias power source (not shown). The developing device 105, incorporating a toner, adheres the toner to electrostatic latent images formed on the photoreceptor drum 104 to perform development (visualization) to form toner image. The toner is supplied to the developing device 105 from the toner bottle 130Y. The drum cleaner 112 removes transfer residual toner remained on the photoreceptor drum 104 after a primary transfer to an intermediate transfer belt 101, which will be described later. Therefore, the drum cleaner 112 has a cleaning blade and the like.

The same reference numerals are used to represent the photoreceptor drums, the primary chargers, the developing units, and the drum cleaners of each process cartridge 103M, 103C and 103K. When particularly necessary, alphabets Y, M, C, and K are added at the end of the reference numerals to make distinction.

An intermediate transfer belt unit 115 is provided at a position opposing to the photoreceptor drums 104 of each process cartridge 103Y, 103M, 103C and 103K. The intermediate transfer belt unit 115 comprises four primary transfer rollers 114, an intermediate transfer belt 101, a driving roller 116 for driving the intermediate transfer belt 101, a transfer cleaning part 107 and a gear on the driving roller shaft (not shown). The driving roller 116 is rotatively driven by a driving gear (not shown). The driving roller 116, arranged to oppose to a secondary transfer roller 117 via the intermediate transfer belt 101, also works as a secondary transfer counter roller. The transfer cleaning part 107 removes residual toner remained on the intermediate transfer belt after the second transfer.

Each of the four primary transfer rollers 114 is respectively arranged at a position opposing to the corresponding photoreceptor drums 104 of each process cartridge 103Y, 103M, 103C and 103K and urged to a direction of the corresponding opposing photoreceptor drums 104. The intermediate transfer belt 101 is provided between each primary transfer roller 114 and each photoreceptor drum 104.

A fixing device 150, having a fixing roller 118 and a pressure roller 119, is provided in a vertical path configuration on a downstream side in a conveyance direction of the recording paper after the transfer by the secondary transfer roller 117. The recording paper is conveyed from a sheet feeding cassette 121 or a manual feed tray 122 one by one to the conveyance path by a sheet feeding roller 135. The recording paper is conveyed along the conveyance path by a drawing roller 136 and a registration roller 123. Then, the recording paper is supplied to the fixing device 150. The recording paper passing the fixing device 150 is discharged to a delivery tray 125 by a discharge roller 124. The delivery tray 125 is provided at the upper part of the main body of the image forming apparatus 100.

A laser exposure 108 is provided at the lower side of each primary charger 109 and each developing device 105 of the process cartridges 103Y, 103M, 103C and 103K. The laser exposure 108 comprises a laser emitter that emits light corresponding to time-series electrical digital pixel signal of predetermined image information. By exposing each photoreceptor drum 104, the laser exposure 108 forms the electrostatic latent images of each color according to the image information on the surface of each photoreceptor drum 104 having been charged by each primary charger 109.

The image forming apparatus 100 having the above-mentioned configuration reads the original by the document reading part 120 when the UI 126 inputs an instruction to start forming images. The original as read is input into the laser exposure 108 as the image information.

Further, in response to the instruction to start forming images from the UI 126, the surface of the photoreceptor drum 104 of each process cartridge 103Y, 103M, 103C and 103K is uniformly charged to negative potential by the primary charger 109. The laser exposure 108 emits according to the image information input from the document reading part 120 and forms the electrostatic latent images of each color on the surface of each photoreceptor drum 104. The developing devices 105 of each process cartridge 103Y, 103M, 103C and 103K adhere toners of each color to the electrostatic latent images formed on the photoreceptor drum 104 to develop the image as toner images.

The toner images formed on each photoreceptor drum 104 are primarily transferred to the intermediate transfer belt 101 being driven by the photoreceptor drum 114 and the primary transfer roller 114 to which the primary transfer high voltage (polarity reverse to the toner, i.e., positive polarity) is applied. The primary transfer is started from the process cartridge 103Y, followed in the order of the process cartridges 103M, 103C and 103K. In this way, full color toner images having placed the toner images of each color such as yellow, magenta, cyan, and black one on another are formed on the intermediate transfer belt 101. Note that the transfer residual toners remaining on each photoreceptor drum 104 after the primary transfer are scraped off and collected by the cleaner blade and the like provided in each drum cleaner 112.

The full color toner images having been transferred to the intermediate transfer belt 101 are moved to a secondary transfer part between the driving roller 116 (secondary transfer counter roller) and the secondary transfer roller 117. The recording paper is fed to the secondary transfer part from the sheet feeding cassette 121 or the manual feed tray 122 in accordance with the timing that the toner images having been transferred to the intermediate transfer belt 101 move to the secondary transfer part. The recording paper is conveyed to the secondary transfer part along the approximately vertically formed conveyance path, by the registration roller 123. The full color toner images are collectively secondarily transferred to the recording paper conveyed to the secondary transfer part by the secondary transfer roller 117. A secondary transfer high voltage (polarity reverse to the toner (positive polarity)) is applied to the secondary transfer roller 117. Note that the residual toners remaining on the intermediate transfer belt 101 after the secondary transfer is scraped off by the transfer cleaning part 107 and collected as waste toners.

The recording paper, on which the full color toner images are transferred, is conveyed to the fixing device 150. The fixing device 150 heats and pressurizes the toner images transferred to the recording paper by a fixing nip part between the fixing roller 118 and the pressure roller 119. The toner images transferred to the recording paper is then heat-fixed by the fixing device 150. The recording paper on which the toner images are fixed is discharged to the delivery tray 125 by the discharge roller 124. The delivery tray is provided at an upper part of the main body of the image forming apparatus 100. A series of the image forming processes is ended in this way.

Figure 2:
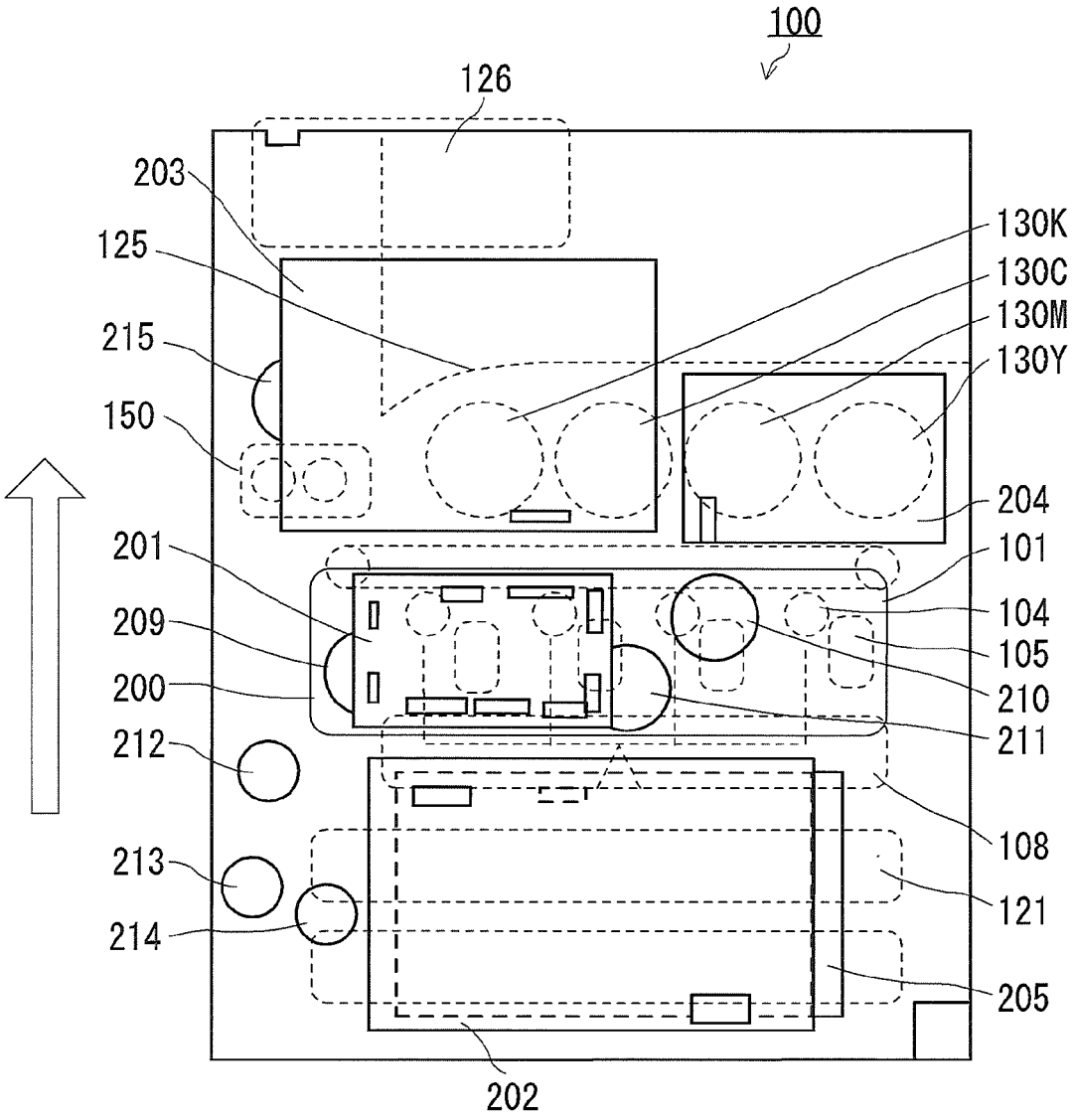
FIG. 2 is a back side view of a main body of the image forming apparatus.
Figure 3:
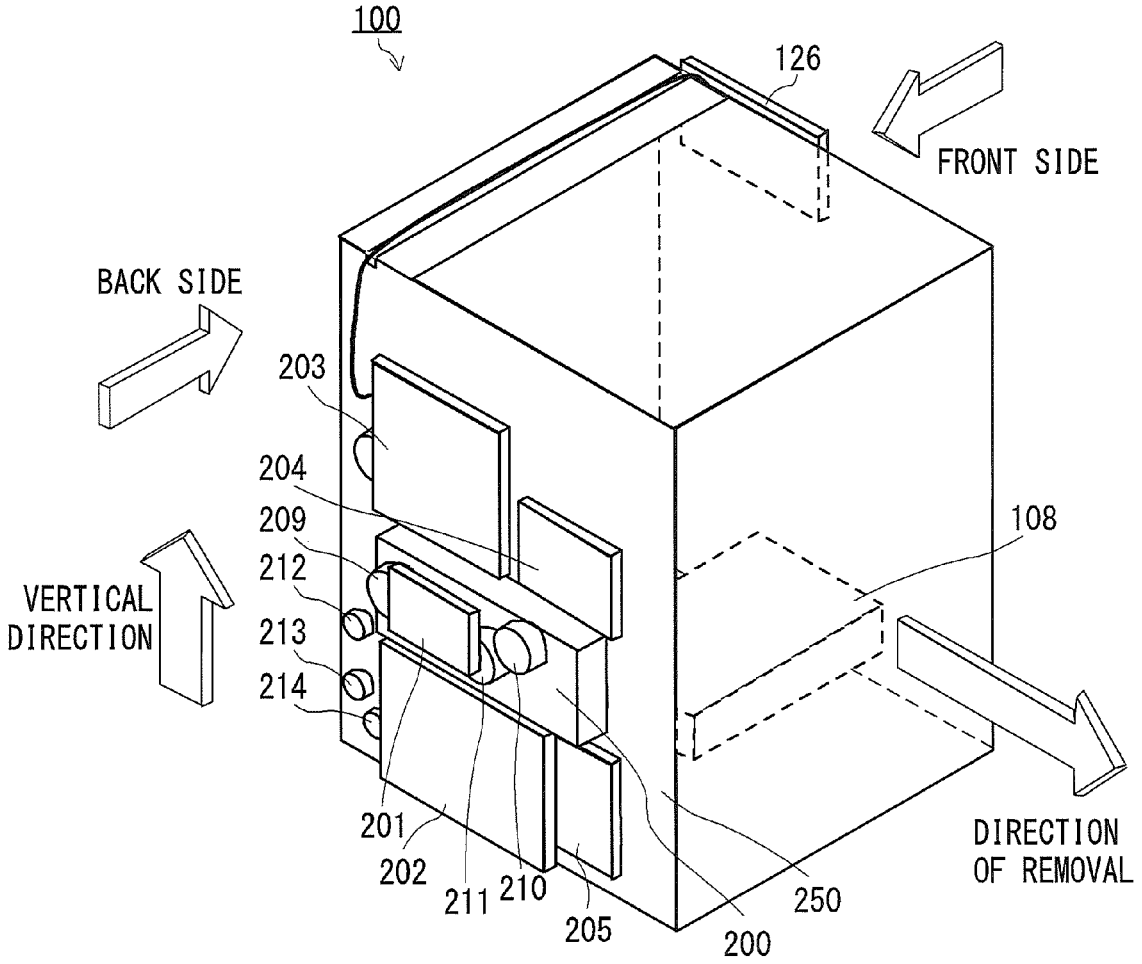
FIG. 3 is a perspective view of the main body of the image forming apparatus when viewed from the back side.

FIG. 2 is a diagram of the image forming apparatus 100 viewed from the back side of the main body. An arrow in FIG. 2 indicates a vertical direction. FIG. 3 is a perspective view of the main body of the image forming apparatus 100 viewed from the back side. The arrows in FIG. 3 respectively indicate a vertical direction, front side and back side of the image forming apparatus 100 and a direction of removal along which the laser exposure 108 is removed. In FIGS. 2 and 3, the broken lines show components which are invisible from the back side of the main body of the image forming apparatus 100.

A front side plate and a back side plate 250 are respectively provided on a front side and a back side of the image forming apparatus 100. Mounting members such as a metal plate for mounting the process cartridges 103Y, 103M, 103C and 103K, the intermediate transfer belt unit 115 and the laser exposure 108 are provided on the front side plate and the back side plate 250. The mounting members are provided with an appropriate configuration and accuracy to allow accurate arrangement of the laser exposure device 108 and the photoreceptor drums 104 of each color, the photoreceptor drum 104 and developing device 105, and the photoreceptor drums 104 of each color and the intermediate transfer belt 101. The back side plate 250 is configured with appropriate strength to mount boards and driving components (motors) thereon, which will be described later.

As described in FIG. 1, in the image forming apparatus 100, the sheet feeding cassette 121 is provided at a bottom side of the main body. The laser exposure 108 is provided at the upper side in the vertical direction of the sheet feeding cassette 121. The laser exposure device 108 is detachable to the left when viewed from a front side of the main body (to the right when viewed from the back side). The four process cartridges 103Y, 103M, 103C, and 103K are arranged approximately horizontally at an upper side in a vertical direction of the laser exposure 108. The intermediate transfer belt unit 115 is arranged at an upper side in a vertical direction of the process cartridges 103Y, 103M, 103C and 103K. The four toner bottles 130Y, 130M, 130Cc and 130K are arranged approximately horizontally at an upper side in a vertical direction of the intermediate transfer belt 115. The recording paper having been supplied from the sheet feeding cassette 121 is conveyed upward in a vertical direction, left side in the main body of the image forming apparatus 100 when viewed from the back side. During the conveyance, the toner images are transferred to the recording paper. The recording paper is heat-fixed by the fixing device 150. Then, the recording paper is delivered to the discharge tray 125. Though invisible from the back side, the UI 126 is arranged at the front side of the main body. In FIG. 2, it is positioned at an upper left part.

A drum ITB motor 209, a color drum motor 210, a developing motor 211, conveyance driving motors 212, 213, 214 for driving rollers for conveying the recording paper, and a fixing motor 215 are provided on the back side (back side plate 250) of the image forming apparatus 100. Each motor is arranged near the components subject for drive.

The drum ITB motor 209 drives the photoreceptor drum 104K and the driving roller 116 of the intermediate transfer belt 101. The color drum motor 210 drives the photoreceptor drums 104Y, 104M and 104C. The developing motor 211 drives a developing screw in each developing device 105. The drum ITB motor 209, the color drum motor 210 and the developing motor 211 are integrated as a main driving unit 200 with a gear that drives the developing screw, each photoreceptor drum 104 and the like to allow collective attachment and detachment of the motors.

The conveyance driving motors 212, 213 and 214 are arranged near the conveyance path of the recording paper. In FIG. 2, the conveyance driving motors 212, 213 and 21 are arranged left side when viewed from the back side. The conveyance driving motor 214 drives the sheet feeding roller 135. The conveyance driving motor 213 drives the drawing roller 136 provided on a downstream side in a conveyance direction of the sheet feeding roller 135. The conveyance driving motor 212 drives the registration roller 123. The fixing motor 215 is arranged near the fixing device 150, which rotatively drives at least one of the fixing roller 118 and the pressure roller 119.

In addition to each motor as mentioned above, a load control board 201, a power source board 202, an image control board 203, a transfer high voltage board 204, and an image forming high voltage board 205 are provided on the back side (back side plate 250) of the image forming apparatus 100.

The image control board 203 is connected to the UI 126 and controls the image forming process. The image control board 203 is arranged at an upper left side when viewed from the back side of the image forming apparatus 100. In order to decrease the length of the wiring connected to the UI 126, a connector is provided near an upper left part of the image control board 203 when viewed from the back side of the image forming apparatus 100. At a left side of the image control board 203 when viewed from the back side of the image forming apparatus 100, connector used to connect with an external device, connector for an external interface (IF) used for network connection and the like are provided.

The power source board 202 distributes AC power supplied from a commercial power supply. Alternatively, it converts the AC power into DC power. The power source board 202 is arranged below the image control board 203 in a vertical direction and at a position closest to a cable that supplies the commercial power supply, which will be described later.

The load control board 201 controls the operation of the load components such as each motor or sensors provided on the image forming apparatus 100. The load control board 201 is arranged below the image control board 203 in a vertical direction and above the power source board 202 in a vertical direction in such a manner that each board does not overlap with other boards. The position at which the load control board 201 is arranged is close to the color drum motor 210 and the developing motor 211. Also, the load control board 201 is arranged to the left of the image forming apparatus 100 when viewed from the back side to closely locate from the conveyance driving motors 212, 213, and 214. The position is a center position of all the load components and the sensors for operating the image forming apparatus 100.

The transfer high voltage board 204 controls the primary transfer high voltage used for the primary transfer. The transfer high voltage board 204 is arranged near the intermediate transfer belt unit 115 (intermediate transfer belt 101), where is a position not overlapping with other boards. In FIG. 2, the transfer high voltage board 204 is arranged to a right side of the image control board 203 when viewed from the back side of the image forming apparatus 100.

The image forming high voltage board 205 generates high voltage that is supplied to each developing device 105. It also generates charged high voltage that is supplied to each photoreceptor drum 104. The image forming high voltage board 205 is arranged between the power source board 202 and the side plate.

The image control board 203 handles many of the high speed signals. Also, it implements integrated circuit (IC) or ball grid array (BGA) of narrow pitch interval. Therefore, the image control board 203 is formed of a multi-layer-structured board (for example, eight-layer board). The power source board 202 handles a primary AC voltage and a secondary DC voltage. From a security perspective, some distance is required between patterns. Therefore, the power source board 202 is formed of a single-sided (one-layer) board. The load control board 201 implements the IC of narrow pitch interval. Therefore, it is formed of a multi-layer (for example, four layers) board. The transfer high voltage board 204 and the image forming high voltage board 205 handle low voltage control signal and high voltage so that some distance is required between patterns. Therefore, the transfer high voltage board 204 and the image forming high voltage board 205 are formed of a single-sided board.

As above, due to the differences in function and layer structure, in the present embodiment, example is shown in a case where each board is split into a plurality of types, however, it is possible to integrate the image control board 203 and the load control board 201 by adjusting the number of the layers of each board to be identical.

Each board is arranged taking into consideration of simple attachment and detachment of the main drive unit 200. In particular, when viewed from the back side of the image forming apparatus 100, approximate clearances are provided on the power source board 202 and under the main drive unit 200 in such a manner that the main drive unit 200 does not overlap with the power source board 202. Similarly, clearances are provided under the image control board 203, on the main drive unit 200, under the transfer high voltage board 204, on the main drive unit 200, on the image forming high voltage board 205, and under the main drive unit 200.

The load control board 201 is smaller than the main drive unit 200 in a vertical direction, which is configured to attach to the main drive unit 200. Note that, as long as the size relationship between the main drive unit 200 and the load control board 201 in the vertical relation is established, it is not necessary that the load control board 201 is configured to attach to the main drive unit 200.

Further, even in a case where the arrangement is made in such a manner that the main drive unit 200 overlaps with the load control circuit 201, as shown in FIGS. 2 and 3, the motor disposed on the main drive unit 200 is arranged such that at least a part of the motors is visually-observed. Therefore, when confirmation of the operation (rotation state) is required, the operation is easily confirmed. Also, the conveyance driving motors 212, 213, and 214 and the fixing motor 215 are arranged such that at least a part of them is visually-observed.

Figure 4:
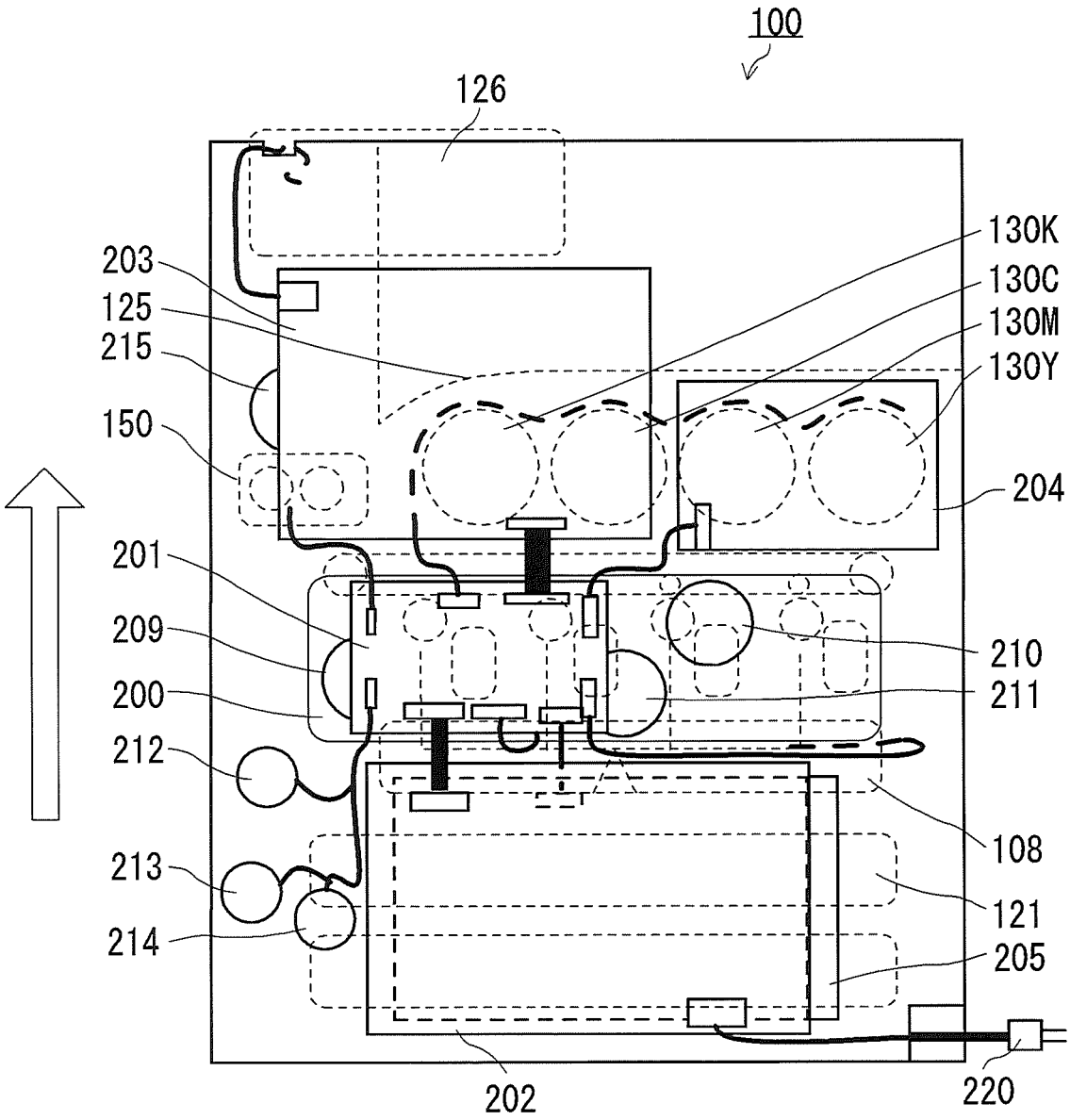
FIG. 4 is an explanatory diagram of wiring of the image forming apparatus.
Figure 5:
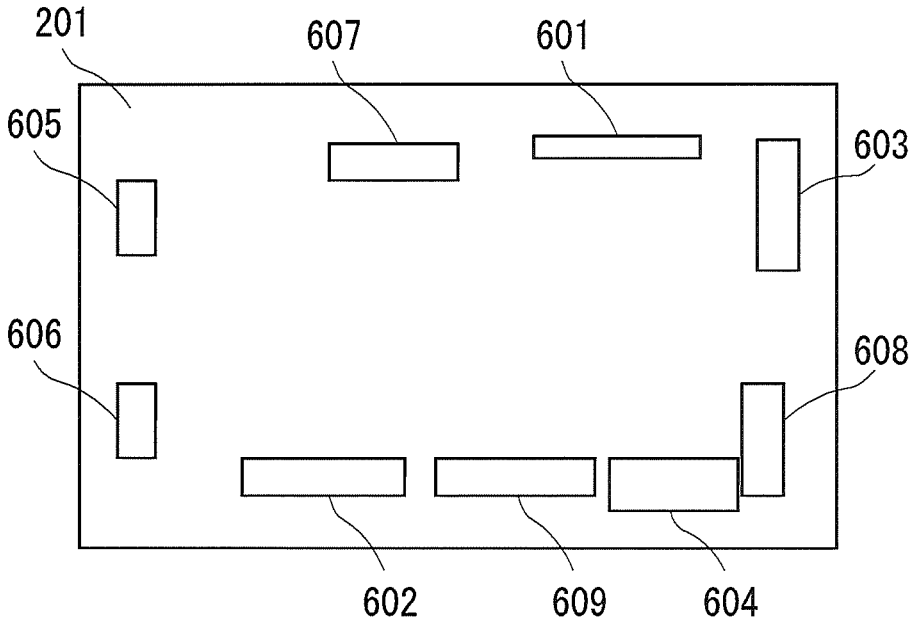
FIG. 5 is a diagram showing arrangement of connectors of a load control board connector.
Figure 6:
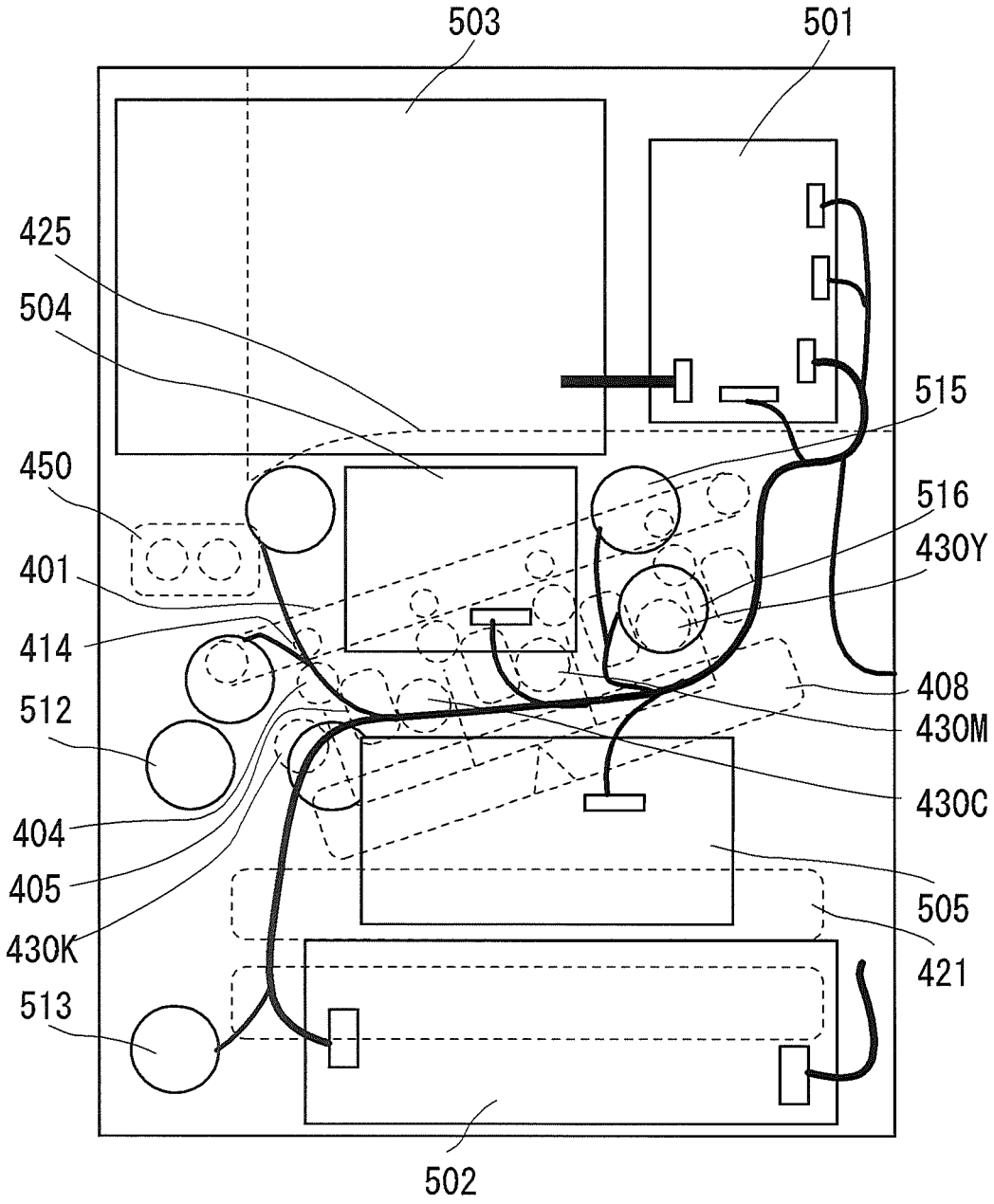
FIG. 6 is a diagram illustrating a configuration of a conventional image forming apparatus.

FIG. 4 is an explanatory diagram of wiring of each board and each motor provided on the back side plate 250 of the image forming apparatus 100. The wiring is a bundled wire that bundled signal lines for transmitting signal, power lines for supplying power etc. In FIG. 4, the wiring is represented by bold lines. The arrow in FIG. 4 indicates a vertical direction. FIG. 5 is a diagram showing arrangement of connectors of a load control board 201. The connectors of the load control board 201 are disposed along with an outer peripheral of the load control board 201 in accordance with the arrangement of other boards and each motor.

A connector that connects from the image control board 203 to the UI 123 is arranged near a vertex of an upper left side of the image control board 203. The position is where, as shown in FIG. 3, enables approximate linear wiring from the back side image control board 203 to the front side UI 126. It is possible to decrease the distance of the wiring that connects from the back side image control board 203 to the front side UI 126.

A connector 601 that connects from the load control board 201 to the image control board 203 arranged at an upper side in a vertical direction of the load control board 201 is arranged at an upper side of the load control board 201. A connecter at the side of the image control board 203 is arranged at a lower side of the image control board 203. These connectors are approximately linearly arranged in a vertical direction to decrease a wiring path. Note that, in a case where the load control board 201 and the image control board 203 are integrally formed, these connectors and the wirings are not required.

A connector 602 that connects from the load control board 201 to the power source 202 arranged at a lower side in a vertical direction of the load control board 201 is arranged at a lower side of the load control board 201. A connector at the side of the power source board 202 is arranged at an upper part of the power supply board 202. These connectors are approximately linearly arranged in the vertical direction to decrease a wiring path.

A connector 603 that connects from the load control board 201 to the transfer high voltage board 204 arranged at an upper right side of the load control board 201 is arranged near a vertex of an upper right side of the load control board 201. A connecter at the side of the transfer high voltage board 204 is arranged near a vertex of a lower left side of the transfer high voltage board 204. Arranging the connecters in this way, the wiring path from the load control board 201 to the transfer high voltage board 204 is decreased as much as possible.

A connector 604 that connects from the load control board 201 to the image forming high voltage board 205 arranged at a lower side in a vertical direction of the load control board 201 is arranged at the lower side of the load control board 201. The connector at the side of the image forming high voltage board 205 is arranged at an upper side of the image forming high voltage board 205. Arranging the connecters in this way, the wiring path from the load control board 201 to the image forming high voltage board 205 is decreased as much as possible.

A connector 605 that connects from the load control board 201 to the fixing device 150 and fixing motor 215 arranged at an upper left side of the load control board 201 is arranged near a vertex of the upper left side of the load control board 201. Arranging the connecters in this way, the wiring paths from the load control board 201 to the fixing device 150 and the fixing motor 215 are decreased as much as possible.

A connector 609 that connects the load control board 201 to the main drive unit 200 is, in this embodiment, arranged at the lower side of the load control board 201. Arranging the connecters in this way, the wiring path from the load control board 201 to the main drive unit 200 is decreased as much as possible.

A connector 606 that connects from the load control board 201 to the conveyance driving motors 212, 213, and 214 arranged at a lower left side of the load control board 201 is arranged near a vertex of the lower left side of the load control board 201. Arranging the connecters in this way, the wiring paths from the load control board 201 to each conveyance driving motor 212, 213 and 214 are decreased as much as possible.

A connector 607 that connects from the load control board 201 to a toner supply section including the toner bottles 130Y, 130M, 130C and 130K arranged at the upper side in the vertical direction of the load control board 201 is arranged at the upper side of the load control board 201. Arranging the connecters in this way, the wiring path from the load control board 201 to the toner supply section is decreased as much as possible.

A connector 608 that connects from the load control board 201 to the board of the laser exposure 108 is arranged at a right side of the load control board 201. This is because the laser exposure 108 is detachable from the right when viewed from the back side of the image forming apparatus 100. Also, the wiring that is connected to the laser exposure 108 is arranged to be accessed from the right when viewed from the back side. Arranging the connecters in this way, the wiring path from the load control board 201 to the laser exposure 108 is decreased as much as possible.

A power code 220 that supplies AC power source from the commercial power source is arranged at a lower right part when viewed from the back side of the image forming apparatus 100. The connector that connects the power source board 202 and the power code 220 is arranged near a vertex of a lower right side of the power source board 202. Arranging the connecters in this way, the wiring path is decreased as much as possible.

In the present embodiment, a recording paper conveyance path is formed at the left side when viewed from the back side of the image forming apparatus 100, through which, the recording paper is discharged to the delivery tray 125 from the sheet feeding cassette 121 via the secondary transfer part and the fixing device 150. Even in a case where the recording paper conveyance path is arranged at the right side when viewed from the back side of the image forming apparatus 100, by arranging with the right and left reversed to the above (i.e., mirror image), similar effect can be obtained by arranging the boards, load components, and wirings in accordance with the same concept.

Arranging the boards, wirings and connectors of the image forming apparatus 100 as above, the wiring path used to connect to the board, load components and sensors become almost shortest. Therefore, the cost for wiring can be reduced. Further, reducing the wiring entails to decline a possibility of a short cut with the metal plate and the like, which enables to improve product quality of the image forming apparatus 100.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-146538, filed Jul. 12, 2013, which is hereby incorporated by reference herein in its entirety.

What is claimed is:

1. An image forming apparatus comprising:

a storing unit configured to store a recording paper;

a conveyance unit configured to convey the recording paper stored in the storing unit;

a conveyance driving unit configured to drive the conveyance unit;

an exposure unit;

a photoreceptor;

a transfer unit configured to transfer a toner image formed on the photoreceptor to the recording paper conveyed by the conveyance unit;

a fixing unit configured to fix the transferred toner image to the recording paper;

a toner storage container;

a toner supply unit configured to supply toner of the toner storage container;

a driving unit configured to drive the photoreceptor;

a control board for controlling the driving unit, said control board being connected to the driving unit through a signal line;

a power source board for supplying power from a commercial power supply for use in the image forming apparatus; and a transfer high voltage board configured to control a primary transfer high voltage, wherein:

the photoreceptor is arranged at the upper side of the storage unit in a vertical direction and at a lower side of the toner storage container in the vertical direction;

the control board and the power source board are arranged on the back side of the image forming apparatus in different positions in a vertical direction such that the control board does not overlap with the power source board when viewed from the back side of the image forming apparatus;

the control board is arranged above the power source board in a vertical direction;

the fixing unit is arranged at an upper left side of the control board in a vertical direction when viewed from the back side of the image forming apparatus;

the conveyance driving unit is arranged at the lower left side of the control board in the vertical direction when viewed from the back side of the image forming apparatus;

the driving unit configured to drive the photoreceptor is arranged such that a part of the driving unit can be visually-observed from the control board to confirm a rotation state when viewed from the back side of the image forming apparatus, and the transfer high voltage board is arranged in such a manner that the transfer high voltage board does not overlap with the control board and the power source board, the control board further comprising:

a first connector for a wiring that connects the control board and the power source board, said first connector being arranged at a lower side of the control board;

a second connector for a wiring that connects the control board and the fixing unit, said second connector being arranged at an upper left side of the control board;

a third connector for a wiring that connects the control board and the conveyance driving unit, said third connector being arranged at the lower left side of the control board when viewed from the back side of the image forming apparatus;

a fourth connector for a wiring that connects the control board and the toner supply unit, said fourth connector being arranged at the upper side of the control board when viewed from the back side of the image forming apparatus; and a fifth connector for a wiring that connects the control board and the exposure unit, said fifth connector being arranged at a right side of the control board when viewed from the back side of the image forming apparatus.

2. The image forming apparatus according to claim 1, further comprising:

an image control board that controls an image forming process, the image control board being arranged at an upper side of the control board in a vertical direction; and the control board further comprising a sixth connector for a wiring that connects the control board and the image control board, the sixth connector being arranged at an upper side of the control board.

3. An image forming apparatus comprising:

a storing unit configured to store a recording paper;

a conveyance unit configured to convey the recording paper stored in the storing unit;

a conveyance driving unit configured to drive the conveyance unit;

an exposure unit;

a photoreceptor;

a transfer unit configured to transfer a toner image formed on the photoreceptor to the recording paper conveyed by the conveyance unit;

a fixing unit configured to fix the transferred toner image to the recording paper;

a toner storage container;

a toner supply unit configured to supply toner of the toner storage container;

a driving unit configured to drive the photoreceptor;

a control board for controlling the driving unit, said control board being connected to the driving unit through a signal line;

a power source board for supplying power from a commercial power supply for use in the image forming apparatus; and an image forming high voltage board configured to generate charged high voltage that is supplied to the photoreceptor, wherein the photoreceptor is arranged at the upper side of the storage unit in a vertical direction and at a lower side of the toner storage container in the vertical direction, the control board and the power source board are arranged on the back side of the image forming apparatus in different positions in a vertical direction such that the control board does not overlap with the power source board when viewed from the back side of the image forming apparatus, the control board is arranged above the power source board in a vertical direction, the fixing unit is arranged at an upper left side of the control board in a vertical direction when viewed from the back side of the image forming apparatus, the conveyance driving unit is arranged at the lower left side of the control board in the vertical direction when viewed from the back side of the image forming apparatus, the image forming high voltage board is arranged between the power source board and the back side of the image forming apparatus, and the control board further comprises a seventh connector for a wiring that connects the control board and the image forming high voltage board, said seventh connector being arranged at a lower side of the control board, the control board further comprising:

a first connector for a wiring that connects the control board and the power source board, said first connector being arranged at a lower side of the control board;

a second connector for a wiring that connects the control board and the fixing unit, said second connector being arranged at an upper left side of the control board;

a third connector for a wiring that connects the control board and the conveyance driving unit, said third connector being arranged at the lower left side of the control board when viewed from the back side of the image forming apparatus;

a fourth connector for a wiring that connects the control board and the toner supply unit, said fourth connector being arranged at the upper side of the control board when viewed from the back side of the image forming apparatus;

a fifth connector for a wiring that connects the control board and the exposure unit, said fifth connector being arranged at a right side of the control board when viewed from the back side of the image forming apparatus.

4. The image forming apparatus according to claim 3, wherein the driving unit configured to drive the photoreceptor is integrated as a main driving unit with a gear that drives the photoreceptor to allow collective attachment and detachment, the control board is arranged to overlap with the main driving unit, and the power source board, the transfer high voltage board, the image control board, and the image forming high voltage board are arranged providing clearances with respect to the main driving unit in such a manner that the power source board, the transfer high voltage board, the image control board, and the image forming high voltage board do not overlap with the main driving unit.

5. The image forming apparatus according to claim 3, wherein the control board and the image control board are formed of a multilayer-structured board, and each of the power source board, the transfer high voltage board, and the image forming high voltage board are formed on a separate single-sided board.

6. An image forming apparatus comprising:

a storing unit configured to store a recording paper;

a conveyance unit configured to convey the recording paper stored in the storing unit;

a conveyance driving unit configured to drive the conveyance unit;

an exposure unit;

a photoreceptor;

a transfer unit configured to transfer a toner image formed on the photoreceptor to the recording paper conveyed by the conveyance unit;

a fixing unit configured to fix the transferred toner image to the recording paper;

a toner storage container;

a toner supply unit configured to supply toner of the toner storage container;

a driving unit configured to drive the photoreceptor;

a control board for controlling the driving unit, the control board being connected to the driving unit through a signal line; and a power source board for supplying power for use in the image forming apparatus from a commercial power supply, wherein the photoreceptor is arranged at the upper side of the storage unit in a vertical direction and at a lower side of the toner storage container in the vertical direction, the control board and the power source board are arranged on the back side of the image forming apparatus in different positions in a vertical direction such that the control board does not overlap with the power source board when viewed from the back side of the image forming apparatus, the control board is arranged above the power source board in a vertical direction, the fixing unit is arranged at an upper side of the control board in a vertical direction and a first side of the control board in a horizontal direction when viewed from the back side of the image forming apparatus, and the conveyance driving unit is arranged at the lower side of the control board in the vertical direction and the first side of the control board in the horizontal direction when viewed from the back side of the image forming apparatus, the control board further comprising:

a first connector for a wiring that connects the control board and the power source board, said first connector being arranged at a lower side of the control board;

a second connector for a wiring that connects the control board and the fixing unit, said second connector being arranged at an upper side of the control board and the first side of the control board in the horizontal direction;

a third connector for a wiring that connects the control board and the conveyance driving unit, said third connector being arranged at the lower side of the control board and the first side of the control board in the horizontal direction when viewed from the back side of the image forming apparatus;

a fourth connector for a wiring that connects the control board and the toner supply unit, said fourth connector being arranged at the upper side of the control board when viewed from the back side of the image forming apparatus; and a fifth connector for a wiring that connects the control board and the exposure unit, said fifth connector being arranged at a second side of the control board in the horizontal direction when viewed from the back side of the image forming apparatus.

7. The image forming apparatus according to claim 6, comprising a transfer high voltage board that controls a primary transfer high voltage, wherein the driving unit configured to drive the photoreceptor is arranged such that a part of the driving unit can be visually-observed from the control board to confirm a rotation state when viewed from the back side of the image forming apparatus, and the transfer high voltage board is arranged such that the transfer high voltage board does not overlap with the control board and the power source board.

8. The image forming apparatus according to claim 6, further comprising:

an image control board that controls an image process, wherein the image control board is arranged at an upper side of the control board in a vertical direction; and the control board further comprises a sixth connector for a wiring that connects the control board and the image control board, said sixth connector being arranged at an upper side of the control board.

9. The image forming apparatus according to claim 6, further comprising:

an image forming high voltage board that generates charged high voltage that is supplied to the photoreceptor, wherein the image forming high voltage board is arranged between the power source board and the back side of the image forming apparatus; and the control board further comprises a seventh connector for a wiring that connects the control board and the image forming high voltage board, said seventh connector being arranged at a lower side of the control board.

10. The image forming apparatus according to claim 9, wherein the driving unit configured to drive the photoreceptor is integrated as a main driving unit with a gear that drives the photoreceptor to allow collective attachment and detachment, the control board is arranged to overlap with the main driving unit, and the power source board, the transfer high voltage board, the image control board, and the image forming high voltage board are arranged providing clearances with respect to the main driving unit in such a manner that the power source board, the transfer high voltage board, the image control board, and the image forming high voltage board do not overlap with the main driving unit.

11. The image forming apparatus according to claim 9, wherein the control board and the image control board are formed of a multilayer-structured board, and each of the power source board, the transfer high voltage board, and the image forming high voltage board are formed on a separate single-sided board.

* * * * *